US009249527B2

(12) United States Patent
Lee et al.

(10) Patent No.: US 9,249,527 B2
(45) Date of Patent: Feb. 2, 2016

(54) METHOD AND APPARATUS FOR MANUFACTURING MELT-BLOWN FABRIC WEB HAVING RANDOM AND BULKY CHARACTERISTICS

(75) Inventors: Jung Wook Lee, Seoul (KR); Gi Won Kim, Gyeonggi-do (KR); Hyeon Ho Kim, Gyeonggi-do (KR); Won Jin Seo, Gyeonggi-do (KR); Dong Uk Lee, Gyeonggi-do (KR); Moon Soo Lim, Gyeonggi-do (KR); Min Su Kim, Ulsan (KR); Jin Ho Hwang, Seoul (KR); Ki Wook Yang, Chungbuk (KR); In Hee Song, Chungcheongnam-do (KR)

(73) Assignees: Hyundai Motor Company, Seoul (KR); Kia Motors Corporation, Seoul (KR); Iksung Co., Ltd., Chungbuk (KR); Sun Jin Industry Co., Ltd., Nonsan (KR)

( * ) Notice: Subject to any disclaimer, the term of this patent is extended or adjusted under 35 U.S.C. 154(b) by 625 days.

(21) Appl. No.: 13/595,152

(22) Filed: Aug. 27, 2012

(65) Prior Publication Data

US 2013/0285275 A1 Oct. 31, 2013

(30) Foreign Application Priority Data

Apr. 30, 2012 (KR) ..... 10-2012-0045260

(51) Int. Cl.

| | |
|---|---|
| ***D01D 5/00*** | (2006.01) |
| ***D01D 5/098*** | (2006.01) |
| ***D04H 3/16*** | (2006.01) |

(52) U.S. Cl.

CPC ..... *D01D 5/0985* (2013.01); *D04H 3/16* (2013.01)

(58) Field of Classification Search

USPC ..... 264/103

See application file for complete search history.

(56) References Cited

U.S. PATENT DOCUMENTS 5,098,636 A * 3/1992 Balk ..... 264/555
5,679,379 A * 10/1997 Fabbricante et al. ..... 425/7

FOREIGN PATENT DOCUMENTS

| | | | |
|---|---|---|---|
| JP | 05321119 | A | 12/1993 |
| JP | 11021754 | A | 1/1999 |
| KR | 10-2006-0004337 | | 1/2006 |
| KR | 10-0821314 | | 4/2008 |

* cited by examiner

*Primary Examiner* — Jacob Thomas Minskey
(74) *Attorney, Agent, or Firm* — Mintz Levin Cohn Ferris Glovsky and Popeo, P.C.; Peter F. Corless

(57) ABSTRACT

Disclosed is a method and apparatus for manufacturing a melt-blown fabric web, by which a melt-blown fabric web having improved filament cohesion and excellent bulky characteristics and sound-absorbing performance is manufactured. The apparatus includes a heat extruder for heating a thermoplastic resin composition and extruding the melted thermoplastic resin, a melt-blown fiber spinner for spinning the extruded thermoplastic resin as a melt-blown fiber in a filament form, a variable gas injector for injecting gas whose injection speed and injection quantity are continuously changed at random to the melt-blown fiber spun from the melt-blown fiber spinner to cause the injected gas to collide with the spun melt-blown fiber, and a collector for collecting the melt-blown fiber, which is spun from the melt-blown fiber spinner and collides with the gas, to form a melt-blown fabric web.

15 Claims, 10 Drawing Sheets

<WATER DROPLET TYPE APPARATUS FOR FABRICATING MELT-BLOWN FABRIC WEB>

<CROSS-SECTIONAL PICTURE OF EMBODIMENT 1>

<CROSS-SECTIONAL PICTURE OF COMPARISON EXAMPLE 1>

METHOD AND APPARATUS FOR MANUFACTURING MELT-BLOWN FABRIC WEB HAVING RANDOM AND BULKY CHARACTERISTICS

CROSS-REFERENCE TO RELATED APPLICATION

This application claims under 35 U.S.C. §119(a) the benefit of Korean Patent Application No. 10-2012-0045260 filed Apr. 30, 2012, the entire contents of which are incorporated herein by reference.

BACKGROUND (a) Technical Field

The present invention relates to a method and apparatus for manufacturing a melt-blown fabric web. More particularly, the present invention relates to a method and apparatus for manufacturing a melt-blown fabric web having improved filament cohesion and bulkiness.

(b) Background Art

Generally, a process of manufacturing a melt-blown fabric web includes a wave forming process in which a thermoplastic resin, such as polypropylene resin, is injected in a perpendicular and downward direction to from filaments. This process lengthens the filaments and provides them in a waveform. In a fabric web forming process, the wave-form filaments are collected and deposited to form a fabric web.

Melt-blown fabric webs composed of microfilaments have been widely used for various types of high-performance filters, wipers, oil absorbents, insulating materials, sound-absorbing materials, and so forth.

Various types of microfiber sound-absorbing materials formed from melt-blown fabric webs have been described. For example, U.S. Pat. No. 3,016,599 describes a fabric web which contains staple fibers of 1 denier in average diameter provided at 25-70 wt % in a micro fiber. U.S. Pat. No. 4,041,203 describes a melt-blown fabric web in which filaments aligned with molecularities of 10 μm and 12 μm are intermittently coupled by means of heat and pressure. U.S. Pat. No. 4,118,531 describes a fabric web having a compression elasticity of at least 30 $cm^3/g$, which is formed of micro fibers and crimped fibers at a ratio of 9:1 or 1:9.

In addition, U.S. Pat. No. 5,841,081 describes a three-dimensional (3D) nonwoven web sound-absorbing material manufactured through a melt-blown processing using a microfiber. U.S. Pat. No. 5,993,943 describes a method for improving rigidity by spinning a melt-blown fiber and passing the fibers through a series of heating chambers to align the melt-blown fibers, and an aligned fiber having no shot manufactured by the method. U.S. Publication No. 2004-0097155 describes a fabric web which is a nonwoven fabric web having no macro pores, which includes 5 wt % or more of a C-shaped staple fiber.

Korean Patent Application Publication No. 2005-0093950, entitled "Wallpaper for Automobile and Manufacturing Method", describes a wallpaper for an automobile in which a nonwoven layer, which contains an amount hollow fiber in the nonwoven fabric formed of a general fiber material, and a heterogeneous cross-section fiber layer are bound and deformed into a spring form. Korean Patent Application Publication No. 2007-0118731, entitled "Sound-Absorbing Material", describes a sound-absorbing material containing a nano-fiber nonwoven fabric composed of a nano fiber of 1,000 nm or less in average diameter.

In addition, Korean Patent Application Publication No. 2008-0055929, entitled "Multi-Layer Product Having Sound-Absorbing Property, and Manufacturing Method and Using Method Thereof", describes a multi-layer product having a sound-absorbing property, which includes a support layer and a submicron fiber layer formed thereon, which is composed of a polymer fiber of 1 μm or less in diameter.

In particular, in the field of sound-absorbing materials, melt-blown fabric webs composed of only a microfiber of a single component (i.e., a polypropylene microfiber 100% form), and a fabric web composed of a microfiber and a staple fiber, which have chemically different components (e.g., in a form in which a melt-blown microfiber of a polypropylene material is mixed with a staple fiber of a polyethyleneterephthalate material of 4-8 deniers), are most widely used.

However, a conventional melt-blown microfiber sound-absorbing material, (e.g., a sound-absorbing material composed of a single-component microfiber produced by a conventional melt-blown production method) fails to provide sufficient sound-absorbing performance, has low cohesion strength between the microfibers, and has a specific fiber directivity in the fabric web. Moreover, in the case of a microfiber sound-absorbing material composed of microfibers and heterogeneous staple fibers, scraps generated during production and usage are not usable and are entirely discarded. Thus, this process is not eco-friendly, and when the scraps are discarded, environmental contaminants may be generated, such as large amounts of carbon dioxide.

SUMMARY OF THE DISCLOSURE

The present invention has been made in an effort to solve the above-described problems associated with prior art, and provides an improved method and apparatus for manufacturing a melt blown fabric web. In particular, the present manufacturing method and apparatus strengthen the cohesion strength of a fabric web by increasing cohesion strength between melt-blown microfibers forming the melt blown fabric web.

The present invention also provides a method and apparatus for manufacturing a melt-blown fabric web having excellent bulky characteristics.

The present invention also provides a method and apparatus for manufacturing a melt-blown fabric web having improved sound-absorbing performance.

The present invention also provides a manufacturing method and apparatus which can arbitrarily adjust a deposition form of a fabric web. In particular, the deposition of the melt-blown microfibers that form the melt blown fabric web can be arbitrarily adjusted.

The present invention also provides a method and apparatus for manufacturing a melt-blown fabric web, in which a thermoplastic resin composition used in forming the melt-blown fibers can be recycled.

In one aspect, the present invention provides an apparatus for manufacturing a melt-blown fabric web, the apparatus including a heat extruder for heating a thermoplastic resin composition and extruding the melted thermoplastic resin; a melt-blown fiber spinner for spinning the thermoplastic resin extruded by the heat extruder as a melt-blown fiber in a filament form; a variable gas injector for injecting gas to the melt-blown fiber spun from the melt-blown fiber spinner to cause the injected gas to collide with the spun melt-blown fiber, wherein speed and quantity of gas injection can continuously changed at random; and a collector for collecting the melt-blown fiber, which is spun from the melt-blown fiber spinner and collides with the gas, to form a melt-blown fabric web.

In another aspect, the present invention provides a method of manufacturing a melt-blown fabric web, the method including extruding, by a heat extruder, a thermoplastic resin that has been melted by heating a thermoplastic resin composition; spinning, by a melt-blown fiber spinning unit, the thermoplastic resin extruded by the heat extruder as a melt-blown fiber in a filament form; injecting gas, by a variable gas injector whose injection speed and injection quantity are continuously changed at random, to the melt-blown fiber spun from the melt-blown fiber spinner and causing the injected gas to collide with the spun melt-blown fiber; and collecting, by a collector, the melt-blown fiber which is spun from the melt-blown fiber spinner and collides with the gas, to form the melt-blown fabric web.

Other aspects and preferred embodiments of the invention are discussed infra.

BRIEF DESCRIPTION OF THE DRAWINGS

The above and other features of the present invention will now be described in detail with reference to exemplary embodiments thereof illustrated the accompanying drawings which are given hereinbelow by way of illustration only, and thus are not limitative of the present invention, and wherein.

Figure 1:
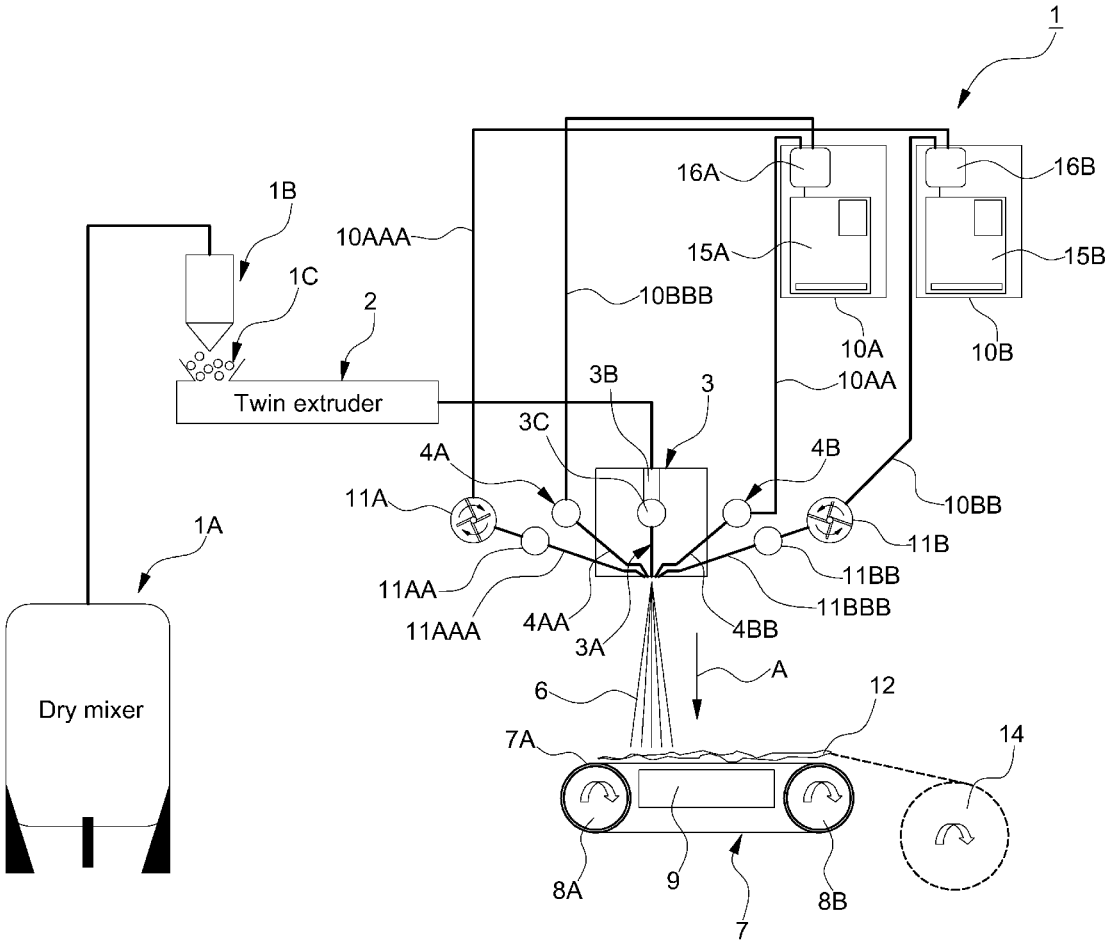
FIG. 1 is a side view schematically showing a structure of an apparatus for manufacturing a melt-blown fabric web according to a first embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings to allow those of ordinary skill in the art to easily carry out the present invention. While the invention will be described in conjunction with the exemplary embodiments, it will be understood that present description is not intended to limit the invention to the exemplary embodiments. On the contrary, the invention is intended to cover not only the exemplary embodiments, but also various alternatives, modifications, equivalents and other embodiments, which may be included within the spirit and scope of the invention as defined by the appended claims.

As used herein, the term "thermoplastic resin" refers to resin in which polymer resin can be repetitively melted by heat of a higher temperature than a melting point, cooled, and then hardened.

Such thermoplastic resin may be classified according to the degree of crystallinity of a polymer into a crystalline type and an amorphous type. Crystalline thermoplastic resins include, for example, polyethylene, polypropylene, nylon, etc., and amorphous thermoplastic resins include, for example, poly vinyl chloride, polystyrene, etc.

As used herein, the term "polyolefin" refers to any arbitrary saturated open chain heavy hydrocarbon family composed of only carbon and hydrogen atoms. In general, polyolefins include various compounds of polyethylene, polypropylene, polymethylpentene and ethylene, and propylene and methylpentene monomers.

As used herein, the term "polypropylene (PP)" includes a copolymer in a propylene unit having 40% or more of a repetition unit as well as a single polymer of propylene.

As used herein, the term "polyester" includes a polymer which is coupled by ester-unit formation and 85% or more of a repetition unit which is a condensation product of dicarboxylic acid and dihydroxyethane alcohol which include alicyclic, saturated and unsaturated diacid and dialcohol. The term "polyester", as used herein, includes copolymers, blends, and modified products thereof. A general example of a polyester is polyethylene terephthalate (PET), which is a condensation product of ethylene glycol and terephthalic acid.

As used herein, the term "melt-blown fiber" and "melt-blown filament" mean a fiber or a filament formed by extruding a melt processible polymer with a high-temperature and high-speed compression gas through a plurality of fine capillary tubes.

According to the present invention, the capillary tube may be modified in various ways, such as by forming it into a tube having a circular cross section, a tube having a cross section of any variety of polygons including triangles, tetragons, and so forth, and a tube having a cross section of an asterisk. Of course, other types of cross sections could also be suitably used as desired. According to various embodiments, the high-temperature and high-speed compression gas may cause a filament of a melted thermoplastic polymer material to be of a thinness such that the diameter of the filament is reduced to about 0.3 through 10 μm. The melt-blown fiber may be a discontinuous fiber or continuous fiber.

As used herein, the term "spunbond" fiber refers to a fabric web manufactured by lengthening a plurality of fine-diameter filaments extruded through the a high temperature capillary tube. The spunbond fiber is continuous in the lengthwise direction of the filament, and is in a fiber form having a diameter greater than the average diameter of the filament. According to a preferred embodiment, the spunbond fiber is in a fiber form having a diameter about 5 μm greater than the average diameter of the filament. In some embodiments, the diameter may be about 3.5 μm greater, 4.0 μm greater, 4.5 μm greater, 5.5 μm greater, 6.0 μm greater, etc.

The spunbond nonwoven fabric or nonwoven web is formed by irregularly placing a spunbond fiber on a collection surface such as a porous screen or belt.

As used herein, the terms "nonwoven product, fabric web, and nonwoven web" refer to structures composed of individual fibers, filaments, or threads which form a planar structure by being irregularly placed without a pattern, in contrast with woven products.

Hereinafter, exemplary embodiments of the present invention will be described in detail with reference to the accompanying drawings.

Figure 2:
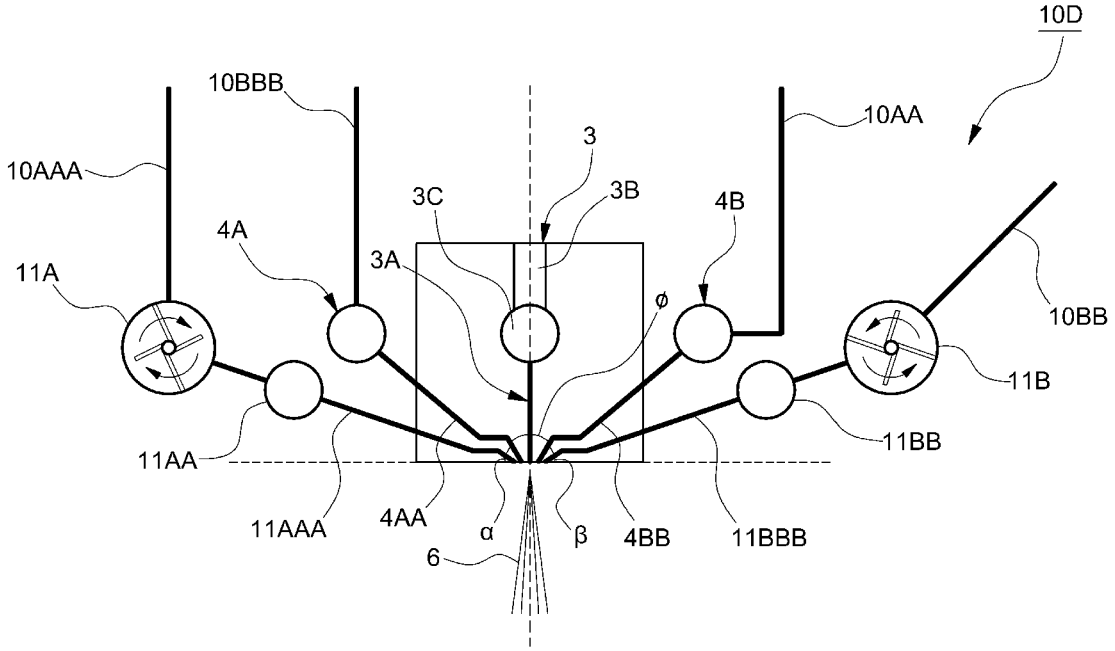
FIG. 2 is a side view schematically showing main parts of an apparatus for manufacturing a melt-blown fabric web according to the first embodiment of the present invention.
Figure 3:
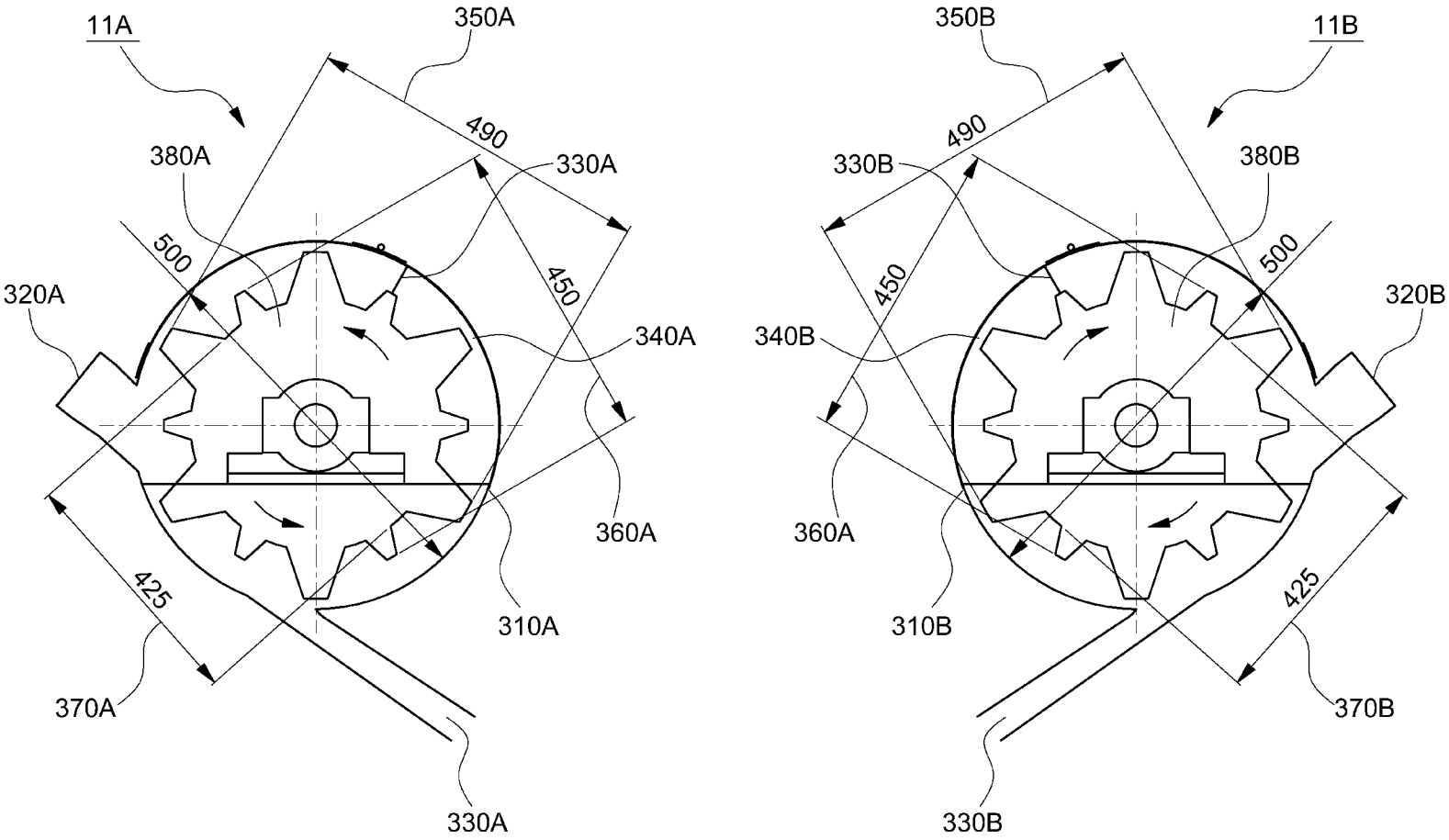
FIG. 3 is a detailed view showing an example of a gas processor in an apparatus for manufacturing a melt-blown fabric web according to an embodiment of the present invention.

FIG. 1 is a side view schematically showing a structure of an apparatus for manufacturing a melt-blown fabric web according to a first embodiment of the present invention, FIG. 2 is a side view schematically showing main parts of an apparatus for manufacturing a melt-blown fabric web according to the first embodiment of the present invention, and FIG. 3 is a detailed view showing an example of a gas processor of an apparatus for manufacturing a melt-blown fabric web according to an embodiment of the present invention.

Figure 4:
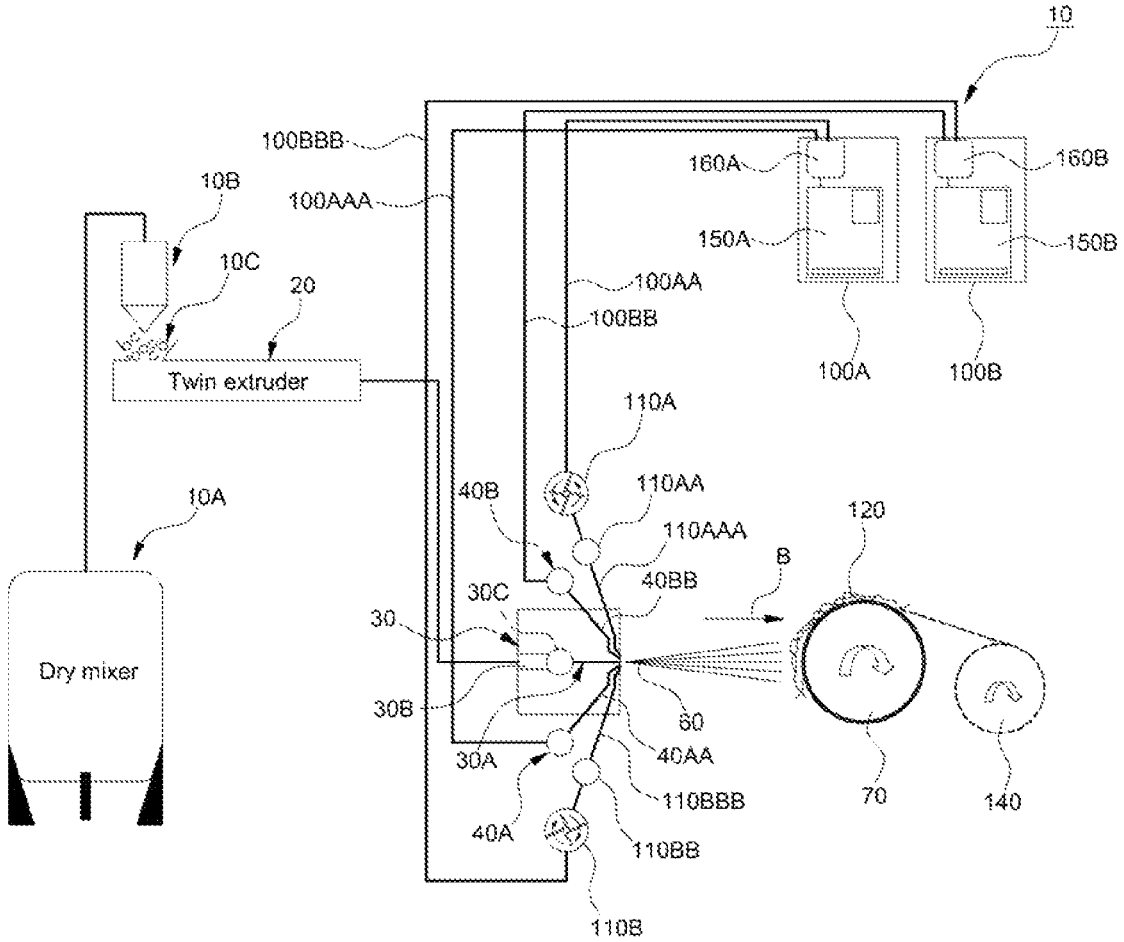
FIG. 4 is a side view schematically showing a structure of an apparatus for manufacturing a melt-blown fabric web according to a second embodiment of the present invention.

FIG. 4 is a side view schematically showing a structure of an apparatus for manufacturing a melt-blown fabric web according to a second embodiment of the present invention.

As shown in FIG. 1, an apparatus 1 for manufacturing a melt-blown fabric web according to a first embodiment of the present invention includes a mixer 1A for mixing a resin composition. The resin composition can, for example, be composed of thermoplastic resin and, if desired, one or more known additives such as an anti-oxidant, a heat stabilizer, and so forth. A drier 1B is positioned downstream the mixer 1A and is configured and arranged for drying the thermoplastic resin composition supplied from the mixer 1A to remove moisture from the thermoplastic resin composition before it is supplied to a heat extruder 2. The heat extruder 2 is configured and arranged for heating, mixing, and melting, and then extruding the thermoplastic resin composition 1C from the drier 1B. A melt-blown fiber spinner 3 is disposed downstream the heat extruder 2, and is configured and arranged for spinning a melt-blown fiber 6 in a filament (microfiber) form in an up/down direction ("self-weight direction" or gravitational direction) with the thermoplastic resin composition extruded from the heat extruder 2. Gas injectors 11AA and 11BB are provided at the spinner for injecting gas to the melt-blown fiber 6 spun from the melt-blown fiber spinner 3 to cause the gas to collide with the melt-blown fiber 6. The gas injectors 11AA and 11BB can be configured so as to allow for continuous and random changes in injection speed and quantity. A collector 7 is further provided for collecting the melt-blown fiber 6 to form a melt-blown fabric web 12. Further, a winder 14 can be provided for winding the fabric web 12 formed on the collector 7.

The fabric web 12 produced by the apparatus an which can be wound by the winder 14 corresponds to a microfiber sound-absorbing material according to the present invention.

According to embodiments of the present invention, the thermoplastic resin composition 1C input into the heat extruder 2 may include polyolefin, polyester, other well-known thermoplastic high polymer resins, and mixtures thereof. The high-polymer resin composition 1C that is input into the heat extruder 2 is heated to transform it into a melted state, and it is then extruded.

If desired, any one or more additives and/or other materials that are conventionally added to such thermoplastic resin compositions, may be added to the thermoplastic resin composition 1C of the invention. For example, one or more inorganic additives, organic additives, as well as polyolefin, polyester, and other well-known thermoplastic high-polymer resins may be added. Further, other suitable additives may include, but are not limited to, one or more heat stabilizers, antioxidants, UV stabilizers, plasticizers, fillers, coloring agents, and anti-blocking agents.

By adding one or more of the inorganic additives and the organic additives, the spinning viscosity of the melted thermoplastic high-polymer resin may be adjusted and/or the physical properties, i.e., the specific gravity and hardness of the filament, may be adjusted as desired. In addition, by adding one or more of the inorganic additives and the organic additives, the surface modification characteristics and durability of the melt-blown fabric web can be improved. The type and amounts of the additives, as well as their impact on the melt-blown fabric, are well known to those of ordinary skill in the art and, thus, will not be described in further detail. As such, the melt-blown fabric web according to the present invention can be composed of one or more types of thermoplastic high-polymer resins and other additives, such that the melt-blown fabric web and materials used in its fabrication can be 100% recycled when discarded.

According to the present invention, the melt-blown fiber spinner 3 may spin the melt-blown fiber 6 in a filament form along an arbitrary first direction such as a widthwise direction (direction 'B') shown in FIG. 4, rather than the longitudinal direction (direction 'A') shown in FIG. 1 (i.e., the "self-weight direction" or gravitational direction). In the present invention, the direction in which the melt-blown fiber 6 in the filament form is spun from the melt-blown fiber spinner 3 is not specifically limited and can include the depicted directions "A", "B" as well as various angular directions.

As shown in FIGS. 1 and 2, the melt-blown fiber spinner 3 includes an inlet 3B through which the melted thermoplastic resin composition 1C supplied from the heat extruder 2 is introduced. The spinner 3 further includes a chamber 3C for temporarily storing the melted thermoplastic high-polymer resin composition 1C introduced through the inlet 3B, and a plurality of filament spinning tubes 3A formed extending from the chamber 3C toward the collector 7.

According to embodiments of the present invention, the inlet 3B of the melt-blown fiber spinner 3 is connected to the heat extruder 2 through a supply tube, so that it can be supplied with the melted thermoplastic resin composition 1C from an outlet of the heat extruder 2. The inlet 3B is further connected to the chamber 3C from which the plurality of filament spinning tubes 3A extend.

The plurality of filament spinning tubes 3A may be provided in various forms, including but not limited to, a cylindrical tube, a tube having a cross section of any variety of polygons such as a triangle, a tetragon, and so forth, and a tube having a cross section of an asterisk.

The filament spinning tube 3A as shown in FIG. 1 appears to be a single filament spinning tube, but in practice, a plurality of filament spinning tubes are typically provided, such as in a perpendicular direction relative to the ground (and the collector 7) of FIG. 1.

The melted thermoplastic resin composition 1C that is temporarily stored in the chamber 3C is transformed into a filament form while it passes through the melt-blown fiber spinner 3, and is discharged in the self-weight/gravitational direction A (or widthwise direction 'B' in the embodiment of FIG. 4, or other angular direction as desired).

According to various embodiments of the present invention, pressure is applied into the chamber 3C by means of a gear pump (not shown), and the filament is spun while subjected to the pressure. Various other pressurizing means, such as a hydraulic pump, a rotary pump, etc., as well as the aforementioned gear pump, may also suitably be used to pressurize the inside of the chamber 3C.

In the present invention, the gas injectors can include a combination of different types of injectors so as to allow for modification in injection quantity and/or speed at any time. For example, as shown in FIGS. 1 and 2, quantitative gas injectors 4A and 4B can be provided which continuously inject gas toward the filament (i.e., the melt-blown fiber 6) discharged through the filament spinner 3A at constant injection speed and by a constant injection quantity; and variable gas injectors 11AA and 11BB can be provided which continuously inject gas toward the filament discharged through the filament spinner 3A by randomly changing injection speed and injection quantity.

The gas injected by the gas injectors 4A, 4B, 11AA, and 11BB lengthens the filament discharged through the filament spinning tube 3A in the longitudinal direction (self-weight direction/gravitational 'A')(or in any other direction in which the filament may be discharged), reduces the diameter of each filament, and gives a wave to the filament.

Each of the gas injectors 4A, 4B, 11AA, and 11BB is connected to gas generators 10A and 10B, and are supplied with gas through gas transfer pipes 10AA, 10BB, 10AAA, and 10BBB. The gas generators 10A and 10B can generate high-temperature and high-speed continuous gas. For example, as shown in FIG. 1, the gas generators 10A and 10B can include gas generating units 15A and 15B for generating high-pressure gas and gas heating units 16A and 16B for heating high-speed gas generated by the gas generating units 15A and 15B.

For example, the gas generating units 15A and 15B for generating high-speed gas, included in the gas generators 10A and 10B, may be compressors or blowers. The gas generating units 15A and 15B may also be turbofans, turboblowers or other suitable units capable of generating high-speed gas.

The gas heating units 16A and 16B for heating high-speed gas may be any variety of heaters, such as an electric heater type or heaters of a boiler heating type which can run by gas or petroleum as a fuel. Of course, other suitable units could alternatively be used that are capable of heating the high-speed gas, and they can be powered by any suitable means.

As shown in FIGS. 1 and 2, gas processors 11A and 11B can be installed on the gas transfer pipes 10BB and 10AAA connected from the gas generator 10B to vary the injection speed and injection quantity of the gas of the variable gas injectors 11AA and 11BB. The gas processors 11A and 11B can be supplied with gas from the gas generator 10B whose temperature, speed, and flux (volume) are constant, can continuously change the injection speed and injection quantity of the gas at random, and can then supply the gas to the variable gas injectors 11AA and 11BB.

The gas processors 11A and 11B, for example, may use a scheme in which a rotor having a plurality of vanes of different lengths are installed in a predetermined-size chamber, and the speed and quantity (volume) of gas discharged from the chamber are continuously changed by variable-speed rotation of the rotor.

Operation of the gas processor as described above will be described below in more detail.

FIG. 3 is a cross-sectional enlarged view the gas processors 11A and 11B which can be applied to the present apparatuses for manufacturing a melt-blown fabric web, such as the apparatuses shown in FIGS. 1, 2, and 4. The gas processors 11A and 11B are configured to be supplied with gas having constant temperature, speed, and volume, and to discharge the gas while continuously changing speed and volume (influx) at random. As shown in FIG. 3, the two gas processors 11A and 11B having the same dimension can be installed symmetrically.

As shown, each of the gas processors 11A and 11B include inlet tubes 320A and 320B at one side, chambers 310A and 310B having outlet tubes 330A and 330B at other sides (i.e. side other than the inlet tubes 320A and 320B), and rotors 380A and 380B which are disposed in the chambers 310A and 310B and which can be rotated at non-constant speed by an external rotation driver (not shown) (whose driving is controlled by a controller (not shown)). A plurality of vanes 340A and 340B, which can have different lengths as shown, may be formed on the circumferences of the rotors 380A and 380B.

The inlet tubes 320A and 320B are disposed so as to allow the gas supplied from the gas generator 10B to be introduced into the chambers 310A and 310B. The inlet tubes 320A and 320B may, in some embodiments, be the gas transfer pipes 10BB and 10AAA connected to the gas generator 10B or they may be separate tubes connected between the gas generator 10B and the chambers 310A and 310B.

The outlet tubes 330A and 330B can be pipes for discharging gas whose speed and influx are changed while passing through the chambers 310A and 310B. The outlet tubes 330A and 330B are connected to the variable gas injectors 11AA and 11BB, such that the gas having changed speed and influx is supplied to the variable gas injectors 11AA and 11BB.

As the rotors 380A and 380B are rotated, the vanes 340A and 340B on the circumferences thereof continuously push and transfer the gas introduced through the inlet tubes 320A and 320B. Further, because the lengths of the vanes 340A and 340B vary, gaps between the inner sides of the chambers 310A and 310B and the vanes 340A and 340B continuously vary as the rotors 380A and 380B rotate, such that the speed and volume of the gas discharged through the outlet tubes 330A and 330B by the vanes 340A and 340B can be continuously changed.

According to a preferred embodiment, the rotors 380A and 380B of the two gas processors 11A and 11B, which as shown in FIG. 2 may be disposed at both left and right sides, are preferably rotated in opposite directions, (e.g., the rotor 380A of the left gas processor 11A is rotated in a counterclockwise direction and the rotor 380B of the right gas processor 11B is rotated in a clockwise direction).

As the rotors 380A and 380B rotate, they repetitively compress and expand the gas introduced through the inlet tubes 320A and 320B, and discharge the gas through the outlet tubes 330A and 330B. As the rotors 380A and 380B rotate, their configuration is such that the speed and volume of the discharged gas are continuously changed at random according to the rotation speed of the rotors 380A and 380B and the length of the vanes 340A and 340B.

While the present invention describes changing the pressure and volume of the introduced gas by using the gas processors 11A and 11B of the foregoing type, any gas processor having various other forms and types, without being limited to the above-described gas processors 11A and 11B, can be used as long as it can continuously change the speed and quantity (volume) of the discharged gas.

The quantitative gas injectors 4A and 4B and the variable gas injectors 11AA and 11BB may be placed symmetrically with respect to the filament spinning tube 3A and the melt-blown fiber (filament) 6 spun through the filament spinning tube 3A, as shown in FIG. 1.

Gas injection nozzles 4AA and 4BB of the quantitative gas injectors 4A and 4B and gas injection nozzles 11AAA and 11BBB of the variable gas injectors 11AA and 11BB may be disposed so as to inject the gas at an incline with respect to the spinning direction of the melt-blown fiber 6, (i.e., when the spinning direction is the self-weight direction A, the incline can be at any angle to direction A).

Preferably, the gas injection nozzles 4AA and 4BB of the quantitative gas injectors 4A and 4B and the gas injection nozzles 11AAA and 11BBB of the variable gas injectors 11AA and 11BB are provided such that a resultant working direction of the injection direction of the gas injected from the gas injection nozzles 4AA and 4BB and of the injection direction of the gas injected from the gas injection nozzles 11AAA and 11BBB is generally parallel to the self-weight direction A.

To this end, the gas injection nozzles 4AA, 4BB, 11AAA, and 11BBB are preferably provided symmetrically with respect to the longitudinal direction of the filament spinning tube 3A, and in this case, the resultant working direction of the injection directions of the gas injected from the gas injection nozzles 4AA, 4BB, 11AAA, and 11BBB may be generally parallel to the self-weight direction A.

The high-temperature gas injected from the quantitative gas injectors 4A and 4B and the variable gas injectors 11AA and 11BB irregularly changes the length and diameter of the filament (melt-blown fiber) 6 discharged through the filament spinning tube 3A and at the same time, continuously changes the form of a wave of the filament at random.

Thus, the deposition pattern of the microfiber can be continuously and irregularly changed, such that a melt-block fabric web having further improved bulky characteristics is manufactured.

According to the present invention, the melt-blown fiber 6 is processed with discontinuous gas which continuously changes in its pressure and volume per unit time. By changing the pattern of the discontinuous gas, the length and diameter of each fiber and the degree of wave formation can be adjusted, thereby adjusting the deposition form, thickness, and cohesion strength of the melt-blown fabric web.

According to exemplary embodiments of the present invention, the quantitative gas injectors 4A and 4B and the variable gas injectors 11AA and 11BB may be placed such that a distance therebetween is about 0.5-20 cm, preferably about 0.5-10 cm. However, such placement is merely an example and other suitable placement could also be used.

The gas used in the present invention may be high-temperature gas, high-speed gas, or high-temperature and high-speed gas. When the high-temperature gas, the high-speed gas, or the high-temperature and high-speed gas is used, the diameter of the filament (melt-blown fiber) 6 spun from the melt-blown fiber spinner 3 can be further reduced.

Any type of gas can be used in the present invention. For example, in some embodiments, the gas may be air. The gas may also be selected from various other gases, including, but not limited to a compound of gaseous nitrogen, oxygen, and vapor at various compounding ratios, and inert gases of a single component.

The aforementioned high temperature refers to a temperature equal to or higher than room temperature (25° C.), and can be selected from any temperature that is capable of lengthening the filament 6 in the longitudinal direction. The temperature of the gas injected to the filament 6 may vary and may be changed as desired.

The aforementioned high speed refers to a speed at which the gas can be injected with a predetermined direction (i.e. the direction at which gas is injected taking into account the spinning direction of the melt-blown fiber 6). Like the temperature, the speed of the injected gas may also vary and may be changed as desired.

A conventional melt-blown fabric web manufacturing facility merely includes a gas injector which injects gas to a filament with constant pressure and injection quantity, e.g., the above-described quantitative gas injectors 4A and 4B according to the present invention or their equivalent devices. Since the gas injector of the conventional melt-blown fabric web manufacturing facility can only inject the gas with constant pressure and injection quantity, the length, diameter, and wave form of the filament colliding with the gas are constant. As such, the deposited fabric web formed thereby has also a specific directivity. This is problematic because a fabric web having a specific directivity is not provided with a sufficient cohesion strength between filaments to adequately maintain the form of the fabric web.

Since conventional melt-blown fabric webs are not formed with a sufficient cohesion strength between filaments, they have been manufactured with a reduced distance between the filament spinning tube 3A and the collector 7 to improve the cohesion strength between the filaments. However, while the reduction in distance between the filament spinning tube 3A and the collector 7 may improve the cohesion strength between the filaments, it may also cause a reduction in the thickness of the fabric web.

On the other hand, by using the apparatus for manufacturing the melt-blown fabric web according to the present invention, a melt-blown fabric web having a large cohesion strength between the filaments and superior bulky characteristics is manufactured. As used herein, the term "bulkiness" means a large volume with respect to weight. Thus, an increase in bulky characteristics provides a lighter fabric web per unit volume.

Hereafter, specific details with respect to the functions of the quantitative gas injectors 4A and 4B and the variable gas injectors 11AA and 11BB will be described in more detail according to an embodiment of the present invention.

When the filament (melt-blown fiber) 6 that is spun by the melt-blown fiber spinner 3 passes to the collector 7, it collides with the high-temperature/high-speed gas, and thermal energy and kinetic energy of the gas are delivered to the filament. As such, that the length of the filament is increased to reduce the diameter thereof, and the filament has the form of a twisted wave.

As previously described, the conventional gas injection method for manufacturing the melt-blown fabric web causes a gas having no change in injection speed and injection quantity to collide with the filament. As such, the length of the filament is increased, the diameter of the filament is reduced, and the wave form of the filament has a specific regularity. When this filament is deposited on the collector 7, the fabric web that is formed cannot have a sufficient cohesion strength between the filaments.

According to the present invention on the other hand, the quantitative gas injectors 4A and 4B inject the gas with constant injection speed and injection quantity through the gas injection nozzles 4AA and 4BB, such that the gas injected from the quantitative gas injectors 4A and 4B collides with the filament 6 to form the filament 6 having constant length and diameter. In addition, the filament 6 also collides with the gas injected from the variable gas injectors 11AA and 11BB that are provided according to the present invention. Because the injection speed and injection quantity of the variable gas injectors 11AA and 11BB can be continuously changed at random, the length, diameter, and wave form of the filament 6 can be continuously and irregularly changed as desired.

As such, in the present invention, filaments 6 having irregular lengths and irregular diameter wave forms are deposited on the collector 7 in an irregular deposition form. When compared to the melt-blown filament produced by a conventional manufacturing apparatus and method, the present invention provides a melt-blown fabric web having further improved cohesion and bulky characteristics of each filament.

As mentioned above, the injection speed and injection quantity of the gas can be changed variously according to designer's purposes by using a combination of quantitative gas injectors 4A and 4B and variable gas injectors 11AA and 11BB according to the present invention.

Figure 6:
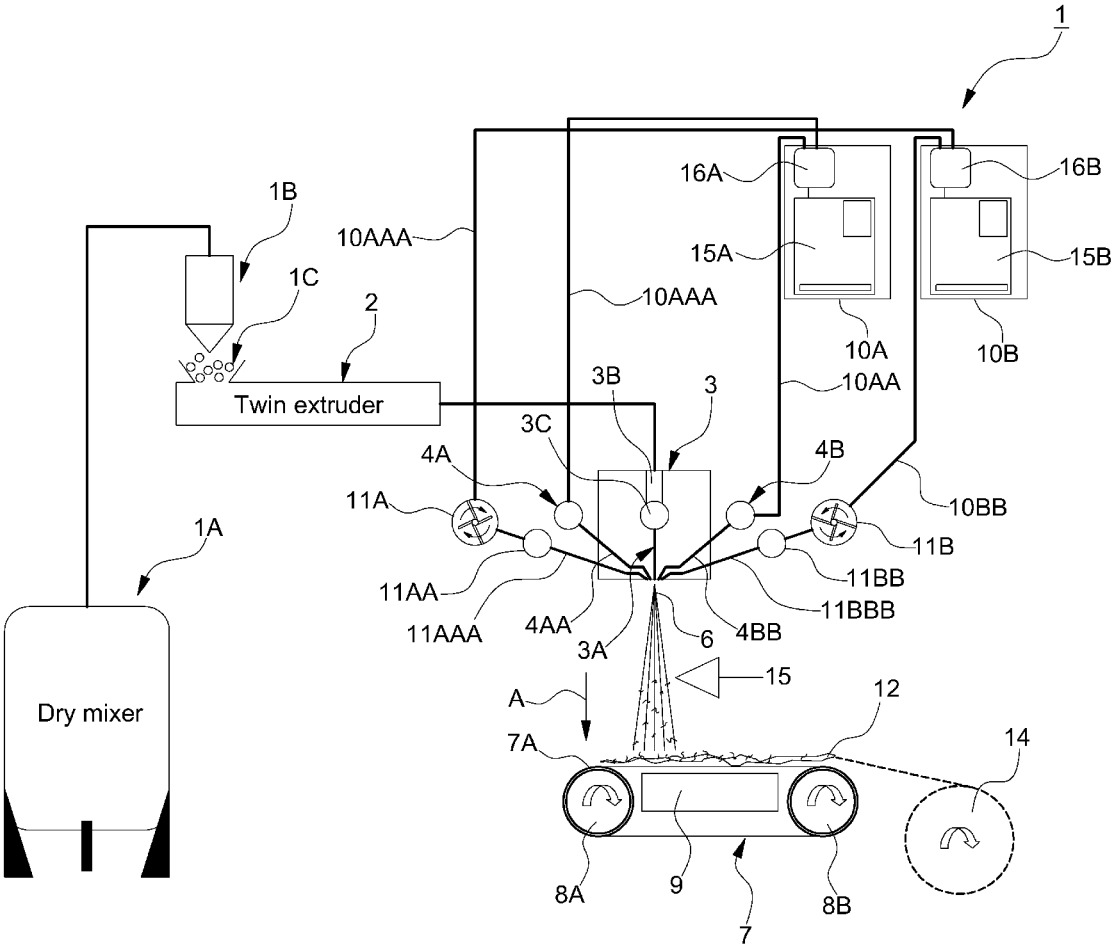
FIG. 6 is a side view schematically showing a structure of an apparatus for manufacturing a melt-blown fabric web according to a third embodiment of the present invention.

As shown in FIGS. 1 and 6, the collector 7 includes a belt 7A on which the filament (melt-blown fiber) 6 is deposited from the spinner 3. The collector 7 can be provided in any of a variety of known forms, and, for example, can include a pair of rollers 8A and 8B for driving the belt 7A as shown. Of course, the collector 7 can be provided in any other suitable form for collecting the filaments 6 and forming the melt-blown fabric web and, for example, in various embodiments the collector 7 may be provided as a rotating cylindrical drum.

Figure 7:
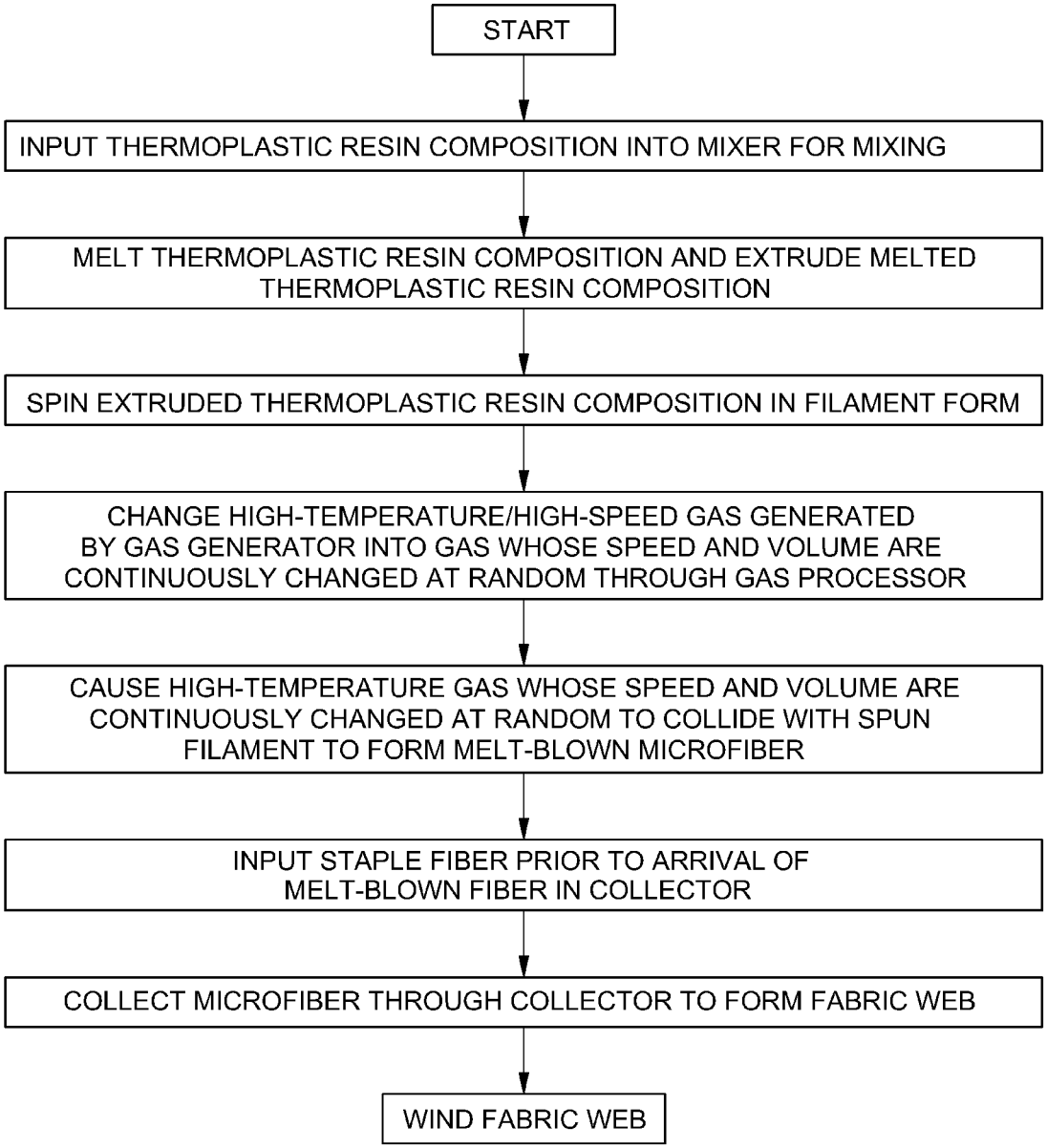
FIG. 7 is a processing flowchart showing a method of manufacturing a melt-blown fabric web according to an embodiment the present invention, in which a staple fiber mixing process is added.

The apparatus 1 for manufacturing the melt-blown fabric web according to the present invention may further include a gas inhalation unit 9 disposed under the melt-blown fiber spinner 3, as shown in FIGS. 1 and 7. The gas inhalation unit 9 can be configured and arranged to assist in providing a constant transfer direction of the filament discharged from the melt-blown fiber spinner 3.

For example, the gas inhalation unit 9 may be positioned under the belt 7A of the collector 7, and can be configured and arranged to inhale gas injected from the gas injectors 4A, 4B, 11AA and 11BB of the melt-blown fiber spinner 3. Thus, the transfer direction of the filament transferred by a flow of the injected high-speed gas can be generally maintained constant.

The spinning direction of the filament 6 spun by the melt-blown fiber spinner 3 may be generally in the self-weight direction A (gravitational direction) as mentioned above. In some cases, the spinning direction of the filament 6 may be in a direction other than the self-weight direction A. As such, the spinning direction of the filament 6 spun by the melt-blown fiber spinner 3 may be referred to herein as a "first direction".

The manufacturing apparatus 1 according to the present invention may further include a winder 14 for winding the fabric web collected by the collector 7. The configuration and positioning of the winder 14 shown in FIG. 1 is only an example, and it may be modified as desired, and in some cases it may be omitted.

As described above, when the fabric web is manufactured by the apparatus 1 for manufacturing the melt-blown fabric web according to the present invention, the extension length, diameter, and the wave form of each filament 6 are continuously changed at random, such that the filament 6 can be randomly deposited on the collector 7 and a melt-blown fabric web having improved cohesion and bulkiness of each filament can be manufactured.

As used herein, "random" refers to "unintentional" having no specific law, rule or directivity.

If desired, a spunbond nonwoven fiber (not shown) having relatively high rigidity can be coupled to one or both surfaces of a melt-blown fabric web 14 manufactured by the manufacturing apparatus 1. The spunbound nonwoven fiber can be coupled by means of any well-known method, such as calendaring.

The apparatus 10 for manufacturing the melt-blown fabric web according to the second embodiment of the present invention, as shown in FIG. 4, has the same structure as that according to the first embodiment of the present invention, except that the spinning direction B of a filament (melt-blown fiber) 60 from the melt-blown fiber spinner 3 is a widthwise direction, and a collector 120 is in a cylindrical shape. The numbering of the components in FIG. 4 differs slightly from that of FIG. 1, wherein the following reference numerals that are different than those in FIG. 1 are as follows: drier 10B, heat extruder 20, melt-blown fiber spinner 30, filament spinning tubes 30A, inlet 30B, chamber 30C, melt-blown fiber 60, collector 70, thermoplastic resin composition 10C, quantitative gas injectors 40A and 40B, gas generators 100A and 100B, gas transfer pipes 100AA, 100BB, 100AAA, and 100BBB, gas processors 110A and 110B, variable gas injectors 110AA and 110BB, fabric web 120, winder 140, gas heating units 160A and 160B, gas generating units 150A and 150B, gas injection nozzles 40AA, 40BB, 110AAA, and 110BBB.

Therefore, the detailed description of the apparatus 10 shown in FIG. 4, which is generally the same as that described in FIG. 1, will be omitted for convenience' sake.

Figure 5:
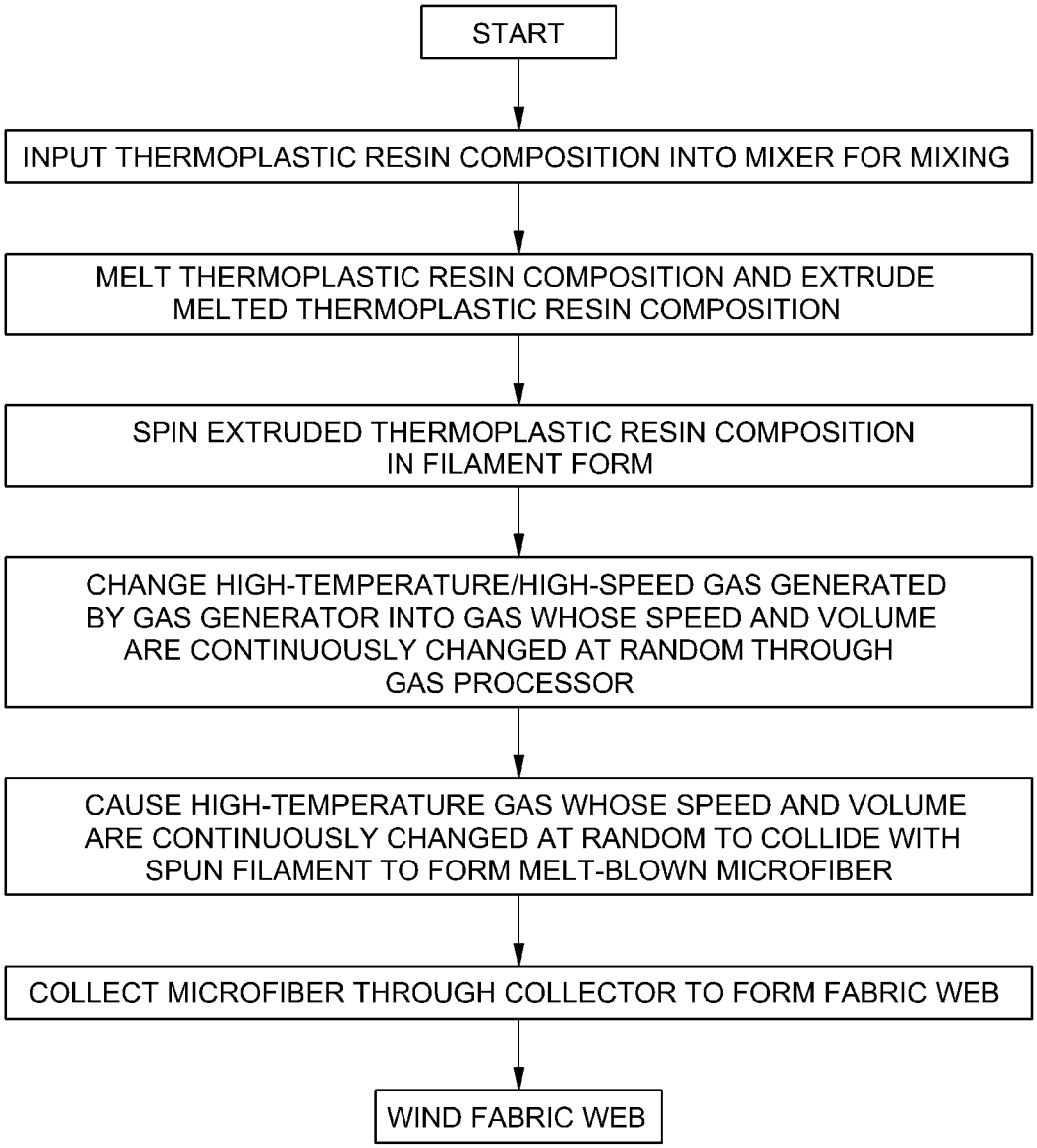
FIG. 5 is a processing flowchart showing a method of manufacturing a melt-blown fabric web according to an embodiment of the present invention.

FIG. 5 is a processing flowchart showing a method of manufacturing a melt-blown fabric web according an embodiment of to the present invention. The general process of manufacturing a fabric web has already been described in the description of the structure of the manufacturing apparatus according to the present invention. Thus, the manufacturing method will be briefly described with reference to FIGS. 1 through 5. As shown, the manufacturing method includes a process of inputting and mixing a thermoplastic resin composition in the mixers 1A and 10A; a process of melting and extruding the mixed thermoplastic resin composition in the heat extruders 2 and 20; a process in which the extruded thermoplastic resin composition is provided to the melt-blown fiber spinners 3 and 30, and spinning the extruded thermoplastic resin composition into the melt-blown fiber 6 in a filament form; a process of changing the high-temperature/high-speed gas provided by the gas generators 10B, 100A, and 100B into a gas whose injection speed and volume per unit time (injection quantity) are continuously changed at random in the gas processors 11A, 11B, 110A, and 110B; a process of causing the high-temperature/high-speed gas whose injection speed and volume (injection quantity) are constant, and the high-temperature/high-speed gas whose injection speed and volume (injection quantity) are continuously changed at random to collide with the melt-blown fiber (filament) 6, thus forming a melt-blown microfiber; a process of collecting the microfiber on the collectors 7 and 70 to form the fabric webs 12 and 120; and a process of winding the fabric webs 12 and 120 on the winders 14 and 140.

FIG. 6 is a side view schematically showing a structure of an apparatus for manufacturing a melt-blown fabric web according to a third embodiment of the present invention, and FIG. 7 is a processing flowchart showing a method of manufacturing a melt-blown fabric web according to the present invention, in which a staple fiber mixing process is added.

As shown in FIGS. 6 and 7, to the above-described fabric web manufacturing process and apparatus (as described in connection with FIGS. 1-5) may further include a configuration and process of inputting a staple fiber (e.g., polypropylene staple fiber) for mixing with the melt-blown fiber (melt-blown microfiber colliding with the gas) 6 prior to being deposited on the collector 7. To this end, the fabric web manufacturing apparatus may, for example, further include a staple fiber input unit 15 for inputting the staple fiber to the melt-blown fiber 6 which is spun from the fiber spinner and collides with the gas.

As shown in FIG. 6, the staple fiber input unit 15 can input the staple fiber in a widthwise direction with respect to the melt-blown fiber 6 which is transferred in a self-weight direction/gravitational direction A to the collector 7. This input direction could be modified as desired with respect to the transfer direction of the melt-blown fiber 6. The input direction of the staple fiber may be in a generally perpendicular direction with respect to the transfer direction of the melt-blown fiber 6, or it could be provided at any other direction relative to the transfer direction of the melt-blown fiber 6.

In the following Examples, fabric webs were manufactured according to embodiments of the present invention, the characteristics and sound-absorbing performance of the fabric webs were tested by changing test conditions variously, and the measured test results are provided below.

To measure the thickness of the fabric web manufactured by a method according to embodiments of the present invention, a 100 mm×100 mm sample was taken from the fabric web and placed on a horizontal sample support, a 150 g pressurizing plate of 120 mm×120 mm was placed on the sample and compressed, and after 10 seconds the thickness was measured with Vernier Calipers. Measurements were carried out with respect to three sheets or more, and an average value was calculated.

The sound-absorbing performance of the samples were tested according to a small reverberation chamber method of the technical standard GM 14177. For the deposition form of the samples, a cross-sectional picture was taken and comparison and evaluation were performed with the naked eyes.

Embodiment 1

The melt-blown fabric web was manufactured by the manufacturing method according to the present invention shown in FIG. 5.

Detailed manufacturing conditions were as follows.

99 wt % of homo polypropylene H7914 high-polymer resin of LG Chem Ltd., having a melt index (230° C., g/10 min) of 1400, 0.5 wt % of an UV stabilizer, Tinuvin 622 of Ciba Specialty Chemical Corp., and 0.5 wt % of a heat stabilizer, Irganox 1010 of Ciba Specialty Chemical Corp., were input into the mixer 1A and were mixed for 10 minutes.

Thereafter, the mixture was passed through the drier 1B at an operational temperature of 80° C. The dried high-polymer resin composition 1C was input into the single extruder (heat extruder) 2 which was rotated 80 times per minute and had a length/dimension of ½8, and then was mixed, heated, and extruded.

The melted high-polymer resin composition was spun in the form of a filament toward the collector through the filament spinning tube 3A of the melt-blown fiber spinner 3 having a diameter of 2 m, which had 32 orifices per inch, each orifice having a diameter of 0.2 mm.

At this time, the spun filament 6 was caused to collide with the high-temperature/high-pressure gas injected from the gas injection nozzles 4AA and 4BB of the quantitative gas injectors and the gas injection nozzles 11AAA and 11BBB of the variable gas injectors, in which each gas injection nozzle had a length of 2 m and its hole size was 5 mm.

The injection conditions for the high-temperature/high-pressure gas were as follows.

A gas generator 10A (indicated as 'gas generator 1' in Table 1) including turbo fans (gas generating units) 15A and 15B for generating gas of 20 lube per minute by using air, and gas heating units 16A and 16B of a heater type was used. The gas (air) with a temperature of 245° C. generated by the gas generator 10A (indicated as 'quantitative gas' in Table 1) was discharged through the gas injection nozzles 4AA and 4BB of the quantitative gas injectors 4A and 4B constantly at 40 m/sec, thereby causing the gas to collide with the filament (melt-blown fiber) 6 spun through the filament spinning tube 3A of the melt-blown fiber spinner 3.

The gas with a temperature of 245° C. generated by another gas generator 10B (indicated as 'gas generator 2' in Table 1) having the same capacity as the gas generator 10A was supplied through the gas transfer pipes 10BB and 10AAA and processed in the gas processors 11A and 11B, such that gas with a temperature of 245° C. (indicated as 'variable gas' in Table 1) was changed continuously 10-15 times per second at a speed of 10-40 m/sec to have a random volume, after which the changed gas was caused to collide with the filament 6 through the gas injection nozzles 11AAA and 11BBB of the variable gas injectors 11AA and 11BB.

For the gas injection nozzles 11AAA and 11BBB of the variable gas injectors 11AA and 11BB, the gas injection nozzles having the same size as the gas injection nozzles 4AA and 4BB of the quantitative gas injectors 4A and 4B were used, and the gas injection nozzles 11AAA and 11BBB of the variable gas injectors 11AA and 11BB were placed with an interval of 10 mm from the gas injection nozzles 4AA and 4BB of the quantitative gas injectors 4A and 4B.

The gas injection nozzles 4AA and 4BB of the quantitative gas injectors 4A and 4B and the gas injection nozzles 11AAA and 11BBB of the variable gas injectors 11AA and 11BB were placed symmetrically with respect to the filament spinning tube 3A, in which each of the gas injection nozzles 4AA, 4BB, 11AAA, and 11BBB was disposed at 40° ('α' and 'β' in FIG. 2) from an end surface of the melt-blown fiber spinner 3 and a total included angle φ between the left and right gas injection nozzles (air channels) was set to 100°.

In addition, a vertical distance between the melt-blown fiber spinner 3 and the collector 7 was 70 cm, and the transfer speed of the belt 7A on the collector 7 was 2.5 m/min. The belt 7A of the collector 7 was transferred toward the winder 14 to form a melt-blown fabric web 12 having a weight of 200 g/m$^2$. This fabric web 12 was then wound around the winder 14 in 50 m units.

Both surfaces of the wound melt-blown fabric web were subsequently combined/coated with a 15 g/m$^2$ spunbond non-woven fiber, thus manufacturing a melt-blown microfiber sound-absorbing material having a weight of 230 g/m$^2$.

Embodiment 2

The filament 6 was spun under the same conditions as in Embodiment 1, but the transfer speed of the belt 7A of the collector 7 was adjusted to 3.4 m/min, and the belt 7A of the collector 7 was transferred toward the winder 14 to form a melt-blown fabric web having a weight of 150 g/m$^2$. Then the fabric web 12 was wound around the winder 14 in 60 m units. Both surfaces of the wound melt-blown fabric web were subsequently combined/coated with a 15 g/m$^2$ spunbond nonwoven fiber, thus manufacturing a melt-blown microfiber sound-absorbing material having a total weight of 180 g/m$^2$.

Embodiment 3

The same conditions as in Embodiment 1 were used, except the staple fiber input unit 15 was further installed at 20 cm and 30 cm in the vertical direction (direction 'A') and in the horizontal direction, respectively, from the melt-blown fiber spinner 3, and the staple fiber was input through the staple fiber input unit 15 to be mixed with the melt-blown fiber 6 which was provided in the direction A. The input staple fiber was made of 100% homopolypropylene, and had an average length of 43 mm and an average thickness of 4 deniers. To facilitate mixing, the surface of staple fiber was first treated with silicon. The speeds of the collector 7 and the staple fiber input unit 15 were adjusted to form a 300 g/m$^2$ melt-blown fabric web in which the staple fiber occupied 10 wt % of a total fabric web weight, after which the melt-blown fabric web was wound around the winder 14 in 40 m units. Both surfaces of the wound melt-blown fabric web were subsequently combined/coated with a 15 g/m$^2$ spunbond nonwoven fiber, thus manufacturing a melt-blown microfiber sound-absorbing material having a total weight of 330 g/m$^2$.

Comparison Example 1

Similar conditions were used in comparison to Embodiment 1, except that the quantitative gas injectors 4A and 4B were used without using the variable gas generators 11AA and 11BB; a gas generation quantity of the gas generator 10A (indicated as 'gas generator 1' in Table 1) was changed into 30 lube per minute; and the speed of gas injected through the gas injection nozzles 4AA and 4BB of the quantitative gas injectors 4A and 4B was changed into 48 m/sec, thus manufacturing the melt-blown fabric web 12 having a weight of 200 g/m$^2$. Both surfaces of the wound melt-blown fabric web were subsequently combined/coated with a 15 g/m$^2$ spunbond nonwoven fiber, thus manufacturing a melt-blown microfiber sound-absorbing material having a total weight of 230 g/m$^2$.

Comparison Example 2

Similar conditions were used in comparison to Embodiment 2, except that the quantitative gas injectors 4A and 4B were used without using the variable gas generators 11AA and 11BB; a gas generation quantity of the gas generator 10A (indicated as 'gas generator 1' in Table 1) was changed into 30 lube per minute; and the speed of gas injected through the gas injection nozzles 4AA and 4BB of the quantitative gas injectors 4A and 4B was changed into 48 m/sec, thus manufacturing the melt-blown fabric web 12 having a weight of 150 g/m$^2$. Both surfaces of the wound melt-blown fabric web were subsequently combined/coated with a 15 g/m$^2$ spunbond nonwoven fiber, thus manufacturing a melt-blown microfiber sound-absorbing material having a total weight of 180 g/m$^2$.

Comparison Example 3

Similar conditions were used in comparison to Embodiment 3, except that the quantitative gas injectors 4A and 4B were used without using the variable gas generators 11AA and 11BB, thus manufacturing a melt-blown fabric web having a weight of 300 g/m$^2$, in which a staple fiber occupied 10 wt % of a total fabric web weight. Both surfaces of the wound melt-blown fabric web were subsequently combined/coated with a 15 g/m$^2$ spunbond nonwoven fiber, thus manufacturing a melt-blown microfiber sound-absorbing material having a total weight of 330 g/m$^2$.

Measurement results using samples manufactured by Embodiment 1, Embodiment 2, Embodiment 3, Comparison Example 1, Comparison Example 2, and Comparison Example 3 are given as below.

TABLE 1

| | Temperature of Injection Gas (° C.) | Gas Generation Quantity of Gas Generator 1 (m$^3$/min) | Gas Generation Quantity of Gas Generator 2 (m$^3$/min) | Speed of Quantitative Gas (m/sec) | Speed of Variable Gas (m/sec) | Total Weight of Fabric Web (g/m$^2$) | Thickness of Fabric Web (mm) | Density of Fabric Web (kg/m$^3$) | Staple Fiber Content (wt %) | Cohesion State of Fabric Web |
|---|---|---|---|---|---|---|---|---|---|---|
| Embodiment 1 | 245 | 20 | 20 | 40 | 10-40 | 230 | 11 | 20.9 | 0 | ○ |
| Comparison Example 1 | 245 | 30 | — | 48 | — | 230 | 8 | 28.8 | 0 | ● |
| Embodiment 2 | 245 | 20 | 20 | 40 | 10-40 | 180 | 9 | 20 | 0 | ○ |
| Comparison Example 2 | 245 | 30 | — | 48 | — | 180 | 7 | 25.7 | 0 | ● |
| Embodiment 3 | 245 | 20 | 20 | 40 | 10-40 | 330 | 16 | 20.6 | 10 | ○ |
| Comparison Example 3 | 245 | 30 | — | 48 | — | 330 | 14 | 23.6 | 10 | ● |

Cohesion State of Fabric Web:
Cohesion is not broken in spite of pull by hand ○
Cohesion is easily broken by a pull by hand, spoiling the shape of the fabric web ●

TABLE 2

| | Hz | | | | | | | | | | | | | | |
|---|---|---|---|---|---|---|---|---|---|---|---|---|---|---|---|
| | 400 | 500 | 630 | 300 | 1K | 1.25K | 1.6K | 2K | 2.5K | 3.15K | 4K | 5K | 6.3K | 8K | 10K |
| Embodiment 1 | 0.31 | 0.46 | 0.61 | 0.70 | 0.93 | 1.00 | 1.19 | 1.14 | 1.04 | 1.19 | 1.09 | 1.10 | 1.06 | 1.15 | 1.10 |
| Comparison | 0.21 | 0.35 | 0.41 | 0.58 | 0.79 | 0.91 | 1.04 | 1.07 | 0.98 | 1.15 | 1.07 | 1.04 | 0.96 | 1.09 | 1.08 |

TABLE 2-continued

| | Hz | | | | | | | | | | | | | | |
|---|---|---|---|---|---|---|---|---|---|---|---|---|---|---|---|
| | 400 | 500 | 630 | 300 | 1K | 1.25K | 1.6K | 2K | 2.5K | 3.15K | 4K | 5K | 6.3K | 8K | 10K |
| Example 1 | | | | | | | | | | | | | | | |
| Embodiment 2 | 0.24 | 0.40 | 0.46 | 0.58 | 0.75 | 0.83 | 1.00 | 1.03 | 1.00 | 1.10 | 1.05 | 0.99 | 1.02 | 1.08 | 0.97 |
| Comparison Example 2 | 0.16 | 0.30 | 0.29 | 0.45 | 0.66 | 0.75 | 0.88 | 0.95 | 0.93 | 1.04 | 1.02 | 0.99 | 1.00 | 1.05 | 0.94 |
| Embodiment 3 | 0.41 | 0.55 | 0.7 | 0.84 | 1.06 | 1.2 | 1.35 | 1.19 | 1.15 | 1.25 | 1.19 | 1.12 | 1.19 | 1.21 | 1.18 |
| Comparison Example 3 | 0.35 | 0.49 | 0.65 | 0.72 | 0.97 | 1.12 | 1.21 | 1.13 | 1.1 | 1.8 | 1.09 | 1.11 | 1.07 | 1.19 | 1.15 |

Table 1 shows measurements of the thickness and cohesion state of the fabric web manufactured under conditions of each of Embodiment 1, Embodiment 2, Embodiment 3, Comparison Example 1, Comparison Example 2, and Comparison Example 3. By comparing results of Embodiment 1, Embodiment 2, Embodiment 3, Comparison Example 1, Comparison Example 2, and Comparison Example 3, the effects of the present invention can be apparently seen.

In particular, by injecting the variable gas while continuously changing the speed of the variable gas at random, in Embodiment 1 in which both the variable gas and the quantitative gas collided with the filament, the density of the fabric web was reduced by about 38% and the thickness of the fabric web was increased by about 38% in comparison to Comparison Example 1 which used only the quantitative gas.

Such results originate from a fact that the length, thickness, and wave form of the filament were changed at random and, thus, regularity cannot be seen in deposition of the fabric web.

Figure 8:
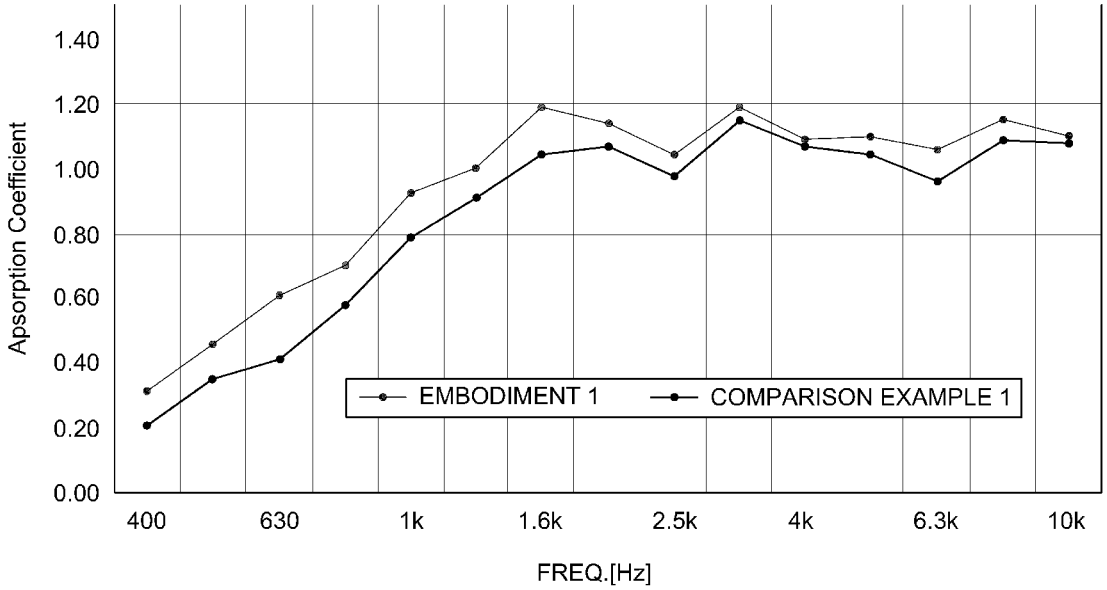
FIG. 8 is a view showing measurements of sound-absorbing performances of fabric webs formed according to Embodiment 1 and Comparison Example 1.

It was further demonstrated from sound-absorbing performance test results of Embodiment 1 and Comparison Example 1 in Table 2 and FIG. 8 that the fabric web of Embodiment 1 shows superior sound-absorbing performance over the entire frequency domain as compared with the fabric web of Comparison Example 1.

Figure 11:
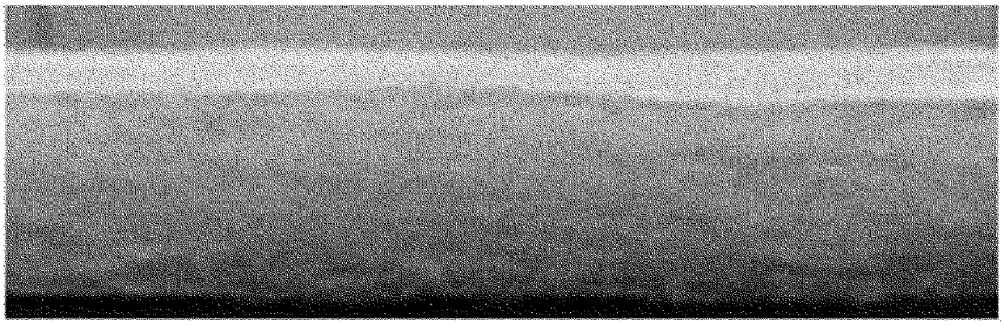
FIG. 11 is a view showing cross-sectional pictures of fabric webs formed according to Embodiment 1 and Comparison Example 1.
Figure 11:
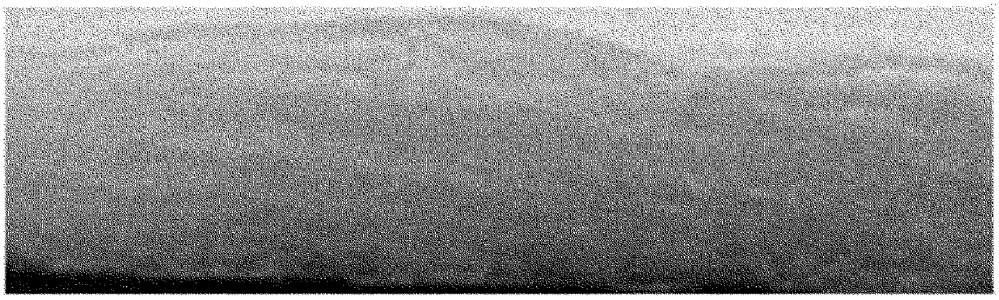

FIG. 11 is a view showing cross-sectional pictures of fabric webs according to Embodiment 1 and Comparison Example 1, in which the filament deposition form of Comparison Example 1 has a clear oblique directivity, but the filament deposition from of Embodiment 1 is more random and has no directivity.

The fabric web of Embodiment 2 had a reduction of about 29% in density and an increase of about 29% in thickness when compared to Comparison Example 1 which did not use the variable gas.

Figure 9:
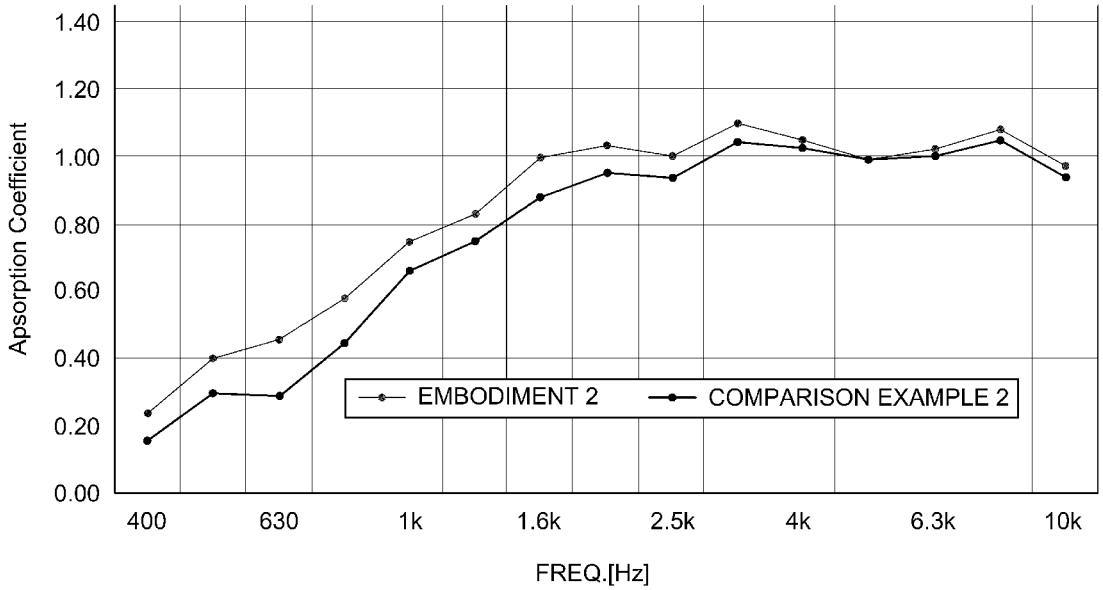
FIG. 9 is a view showing measurements of sound-absorbing performances of fabric webs formed according to Embodiment 2 and Comparison Example 2.

As demonstrated by the sound-absorbing performance test results of Embodiment 2 and Comparison Example 2 in Table 2 and FIG. 9, the fabric web of Embodiment 2 showed higher sound-absorbing performance over the entire frequency domain as compared with the fabric web of Comparison Example 2.

It is believed that the thickness of the fabric web is increased by processing the filament with the variable gas, thus improving the sound-absorbing performance.

Thus, with the apparatus and method for manufacturing the melt-blown fabric web according to the present invention, a fabric web which is more bulky than that prepared by a conventional production scheme, and has excellent cohesion of the filament and improved sound-absorbing performance can be manufactured.

In Embodiment 3 and Comparison Example 3, the fabric web was manufactured by mixing the staple fiber of a homopolypropylene material into the melt-blown fiber. In this case, it was demonstrated that the same result tendencies as the test results of Embodiment 1 and Embodiment 2 and Comparison Example 1 and Comparison Example 2 could be obtained.

In other words, in Embodiment 3, when compared to Comparison Example 3, the density of the fabric web was reduced by about 14% and the thickness of the fabric web was increased by about 14%.

Figure 10:
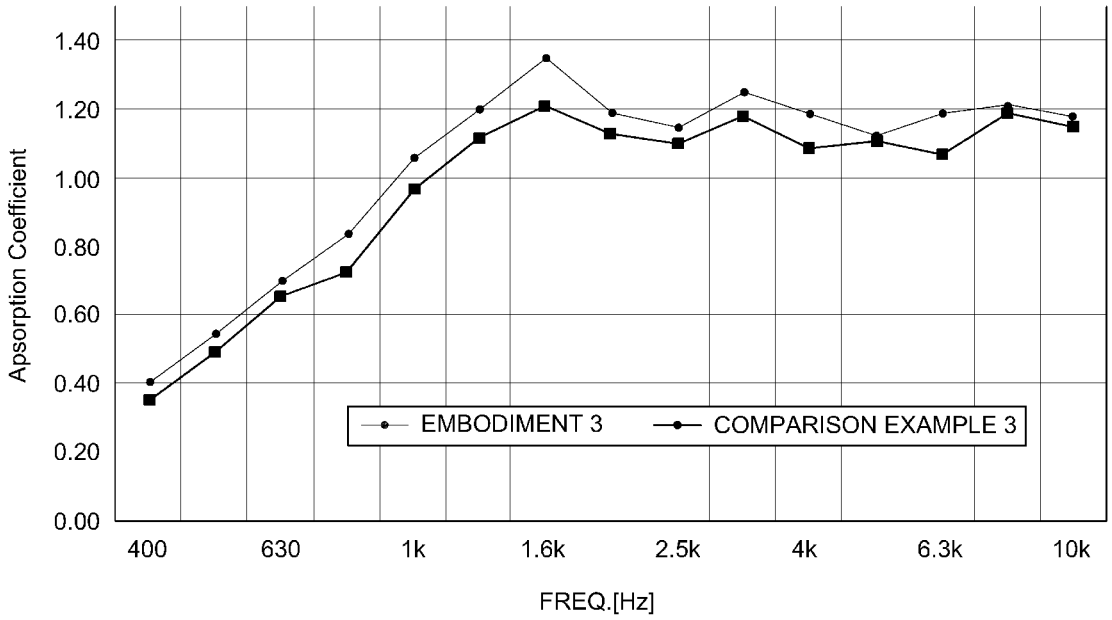
FIG. 10 is a view showing measurements of sound-absorbing performances of fabric webs formed according to Embodiment 3 and Comparison Example 3.

As demonstrated by the sound-absorbing performance test results of Embodiment 3 and Comparison Example 3 in Table 2 and FIG. 10, the fabric web of Embodiment 3 shows higher sound-absorbing performance over the entire frequency domain as compared to the fabric web of Comparison Example 3.

As demonstrated by the test results, by using a gas whose speed and volume were changed at random, a fabric web having excellent bulky characteristics, cohesion strength, and sound-absorbing performance can be manufactured.

Therefore, with the above-described method and apparatus for manufacturing the melt-blown fabric web according to the present invention, the following effects can be obtained.

First, a melt-blown fabric web having improved cohesion of each filament can be manufactured.

Second, a melt-blown fabric web having excellent bulky characteristics can be manufactured.

Third, a melt-blown fabric web having improved sound-absorbing performance can be manufactured.

Fourth, by changing the deposition form of the fabric web in an easy way, a desired melt-blown fabric web can be manufactured.

Fifth, a recyclable melt-blown fabric web can be manufactured.

While certain embodiments have been described, these embodiments have been presented by way of example only, and are not intended to limit the scope of the disclosures. Further, it will be apparent to those skilled in the art that modifications and variations not exemplified above can be made in the scope not departing from essential properties. For example, each component shown in detail in the embodiments may be modified and implemented. In addition, it should be understood that difference associated with the modification and application are included in the scope of the present invention defined in the appended claims.

What is claimed is:

1. An apparatus for manufacturing a melt-blown fabric web, the apparatus comprising:

a heat extruder configured and arranged for heating a thermoplastic resin composition and extruding a melted thermoplastic resin;

a melt-blown fiber spinner configured and arranged to receive the thermoplastic resin extruded by the heat extruder and spin the thermoplastic resin as a melt-blown fiber in a filament form;

a variable gas injector configured and arranged for injecting gas so as to collide with the melt-blown fiber spun from the melt-blown fiber spinner; and a collector for collecting the melt-blown fiber that has been spun from the melt-blown fiber spinner and has collided with the gas, to form a melt-blown fabric web, wherein a gas processor is connected to the variable gas injector to continuously change the speed and influx of the gas supplied from a gas generator at random and supply the changed gas, the gas processor comprising a chamber and a rotor disposed within the chamber, the rotor having vanes of different lengths on a circumference thereof for transferring the gas, the rotor being rotatable at non-constant speed by a rotation driver to push the gas introduced through an inlet tube of the chamber and discharge the gas through an outlet tube of the chamber.

2. The apparatus of claim 1, wherein a plurality of variable gas injectors are provided and are disposed symmetrically with respect to a spinning direction of the melt-blown fiber to inject the gas in opposite directions.

3. The apparatus of claim 2, wherein each of the variable gas injectors is disposed to inject the gas at an incline with respect to the spinning direction of the melt-blown fiber.

4. The apparatus of claim 1, further comprising a quantitative gas injector configured and arranged to continuously inject gas supplied from a gas generator to collide with the melt-blown fiber spun from the melt-blown fiber spinner with constant injection speed and injection quantity.

5. The apparatus of claim 4, wherein a plurality of quantitative gas injectors are provided and are disposed symmetrically with respect to a spinning direction of the melt-blown fiber to inject the gas in opposite directions.

6. The apparatus of claim 5, wherein each of the quantitative gas injectors is disposed to inject the gas at an incline with respect to the spinning direction of the melt-blown fiber.

7. The apparatus of claim 1, wherein the gas processor is configured and arranged to continuously change the speed and influx of the gas supplied from a gas generator at random and supply the changed gas.

8. The apparatus of claim 1, further comprising a staple fiber input unit configured and arranged for inputting a staple fiber into the melt-blown fiber spun from the finer spinning unit.

9. A method of manufacturing a melt-blown fabric web, the method comprising:

heating a thermoplastic resin composition and extruding the melted thermoplastic resin at a heat extruder;

spinning the thermoplastic resin extruded by the heat extruder as a melt-blown fiber in a filament form, through a melt-blown fiber spinning unit;

injecting gas to the melt-blown fiber spun from the melt-blown fiber spinner and causing the injected gas to collide with the spun melt-blown fiber, while continuously and randomly changing the injection speed and injection quantity of the gas while the gas is injected, through a variable gas injector connected to a gas processor; and collecting the melt-blown fiber, which is spun from the melt-blown fiber spinner and collides with the gas, through a collector, to form the melt-blown fabric web, wherein the as processor comprises a chamber and a rotor disposed within the chamber, the rotor having vanes of different lengths on a circumference thereof for transferring the gas, the rotor being rotatable at non-constant speed by a rotation driver to push the as introduced through an inlet tube of the chamber and discharge the gas through an outlet tube of the chamber.

10. The method of claim 9, wherein the gas is injected to the melt-blown fiber in opposite directions by a plurality of variable gas injectors disposed symmetrically with respect to a spinning direction of the melt-blown fiber.

11. The method of claim 10, wherein the gas is injected at an incline with respect to a spinning direction of the melt-blown fiber through each of the plurality of variable gas injectors.

12. The method of claim 9, wherein gas supplied from a gas generator is further continuously injected to the melt-blown fiber spun from the melt-blown fiber spinner with constant injection speed and injection quantity to cause the supplied gas to collide with the spun melt-blown fiber.

13. The method of claim 12, wherein the gas is injected to the melt-blown fiber with constant injection speed and injection quantity in opposite directions by a plurality of quantitative gas injectors disposed symmetrically with respect to a spinning direction of the melt-blown fiber.

14. The method of claim 12, wherein the gas is injected at an incline with respect to a spinning direction of the melt-blown fiber through each of the plurality of quantitative gas injectors.

15. The method of claim 9, further comprising a staple fiber mixing step of inputting a staple fiber into the melt-blown fiber which is spun from the finer spinning unit and collides with the gas, to thereby mix the staple fiber with the melt-blown fiber, through a staple fiber inputting unit.

* * * * *